US005587569A

United States Patent [19]

Mohtasham

[11] Patent Number: 5,587,569

[45] Date of Patent: Dec. 24, 1996

[54] SAFETY SWITCH ASSEMBLIES

[75] Inventor: Mehdi Mohtasham, Wigan, United Kingdom

[73] Assignee: E. J. A. Engineering PLC, Wigan, United Kingdom

[21] Appl. No.: 256,262

[22] PCT Filed: May 28, 1993

[86] PCT No.: PCT/GB93/01135

§ 371 Date: Jun. 24, 1994

§ 102(e) Date: Jun. 24, 1994

[87] PCT Pub. No.: WO93/24947

PCT Pub. Date: Dec. 9, 1993

[30] Foreign Application Priority Data

Jun. 2, 1992 [GB] United Kingdom ..... 9211603
Nov. 12, 1992 [GB] United Kingdom ..... 9223751

[51] Int. Cl.[6] ..... H01H 3/16

[52] U.S. Cl. ..... 200/17 R; 200/61.62; 200/43.07

[58] Field of Search ..... 200/17 R, 43.01, 200/43.04–43.09, 50 R, 50 A, 61.62

[56] References Cited

U.S. PATENT DOCUMENTS

| | | | |
|---|---|---|---|
| 3,205,320 | 9/1965 | Soscia | 200/44 |
| 4,395,608 | 7/1983 | Eicker et al. | 200/153 L |
| 4,524,251 | 6/1985 | Schulz | 200/42 R |
| 4,658,102 | 4/1987 | Seim et al. | 200/17 R |
| 4,963,706 | 10/1990 | Mohtasham | 200/334 |

FOREIGN PATENT DOCUMENTS

| | | | |
|---|---|---|---|
| 2425898 | 12/1975 | Germany | F16P 3/08 |
| 7627192 | 12/1976 | Germany | H01H 13/18 |
| 3302631 | 8/1984 | Germany | H01H 9/20 |
| 217600 | 1/1985 | Germany | F16P 3/08 |
| 3444325 | 6/1986 | Germany | F16P 3/08 |
| 3806189 | 9/1989 | Germany | F16P 3/08 |
| 8120397 | 7/1991 | Germany | H01H 13/18 |
| 4039652 | 3/1992 | Germany | H01H 3/20 |
| 9008396 | 7/1990 | WIPO | H01H 27/00 |
| 9110247 | 7/1991 | WIPO | H01H 27/00 |

OTHER PUBLICATIONS

German Patent Search Report, Appl. No. G 93 08 260.6.

Search report dated Aug. 25, 1994, PCT application Ser. No. PCT/GB93/01135, filed May 28, 1993.

*Primary Examiner*—Brian W. Brown
*Assistant Examiner*—Michael A. Friedhofer
*Attorney, Agent, or Firm*—Loeb & Loeb LLP

[57] ABSTRACT

A safety switch assembly for fitting to a safety enclosure. The switch includes a rotatable cam which operates electrical contacts. An actuator is insertable into the switch housing through either of two apertures to engage locking members. The locking members move in a rectilinear direction perpendicular to the cam axis away from the actuator and our of locking engagement with the cam. Ears on the actuator then engage in pockets in the cam and rotate the cam which causes movement of the electrical contacts to the ON position. Each locking member comprises a pair of locking components one of which is slidable on the other and both of which define elongate slots through which a cam shaft extends. The slots are inclined such that when the actuator pushes either one of the components away from a first aperture the other component is forced to move away from the other aperture.

16 Claims, 9 Drawing Sheets

SAFETY SWITCH ASSEMBLIES

BACKGROUND OF THE INVENTION

1. Field of the Invention

This invention relates to safety switch assemblies used especially but not exclusively in machinery guards enclosing kinetic machinery.

Known safety switch assemblies comprise a safety switch adapted to be fitted to an enclosure and an actuator adapted to be fitted to a door, gate or protective cover of the enclosure and insertable into the safety switch to turn ON the electrical power supply when the enclosure is closed by the door, gate or protective cover.

2. Description of the Prior Art

Known safety switches comprise within a housing normally-open contacts, one set fixed, and the other movable and carried by an axially-movable push rod spring-loaded to maintain the sets of contacts apart and the power supply consequently OFF.

The axially-movable push rod is connected to a rotatable cam of a cam arrangement normally disposed to prevent cam rotation and consequently to secure the push rod in a power supply OFF position but which is operable by the actuator to cause cam rotation and axial movement of the push rod to a power supply ON position.

Cam arrangements are known in which the rotatable cam prevented from rotating by a releasable connection between the cam and a non-rotatable locking element, rotation of the cam and consequent axial movement of the push rod from the OFF position to the ON position being effected by the actuator engaging the rotatable cam either to move the cam axially along its axis of rotation to release the connection between the rotatable cam and non-rotatable locking element, or to move the latter axially along a shaft defining the axis of rotation of the cam to release the connection with the cam.

These known cam arrangements are vulnerable to loss of free axial movement of the cam or the locking element along the cam shaft due to the accumulation of dust and grease between the latter and the cam or the locking element which may inhibit their axial displacement by the actuator or their return to the locked position upon withdrawal of the actuator.

It is an object of the present invention to provide an improved switch assembly.

SUMMARY OF THE INVENTION

According to the present invention there is provided a safety switch comprising a housing containing electrical contacts movable from a power supply OFF position to a power supply ON position by rotation of an actuating cam also contained within the housing and adapted to be rotated about a predetermined axis by an actuator of a predetermined shape insertable into the housing, wherein at least one locking member is mounted within the housing for movement in a direction perpendicular to the axis of rotation of the actuating cam, and the or each locking member is resiliently urged towards engagement with the actuating cam to prevent rotation thereof and consequent movement of the electrical contacts to the power supply ON position, the actuator being shaped such that when inserted into the housing it engages and displaces the or each locking member away from the path of movement of the actuator and out engagement with the actuating cam, and engages and rotates the cam to cause movement of the electrical contacts to the power supply ON position.

Preferably there are two locking members each slidably mounted on tracks defined by the housing. The housing may define two apertures through which the actuator is insertable to contact the locking members and the actuating cam, the two apertures opening in mutually perpendicular directions.

The actuating cam is preferably arranged so as to rotate in the same direction as the result of insertion of the actuator through either aperture. Preferably each locking member comprises a first component slidably mounted on the housing and a second component slidably mounted on the first, the first and second components being arranged such that insertion of the actuator through one aperture causes it to contact one component whereas insertion of the actuator through the other aperture causes it to contact the other component. Each locking member component may define an elongate slot through which a shaft mounted on the housing extends, the slots being mutually inclined and defining the respective directions in which the respective components are forced to move relative to the housing. The second locking member component may be slidable relative to the first component in a direction perpendicular to the direction in which the first component is slidable relative to the housing, and the slots are inclined at an angle of 45° to each other. The first locking member component may be spring biased by a compression spring bearing against a wall of the housing towards a position in which it engages and locks the actuating cam against rotation.

Preferably the actuating cam defines at least one abutment surface which is engageable by the or each locking member and acts on a plunger which is movable to control the electrical contacts. The actuating cam may define an arcuate slot in which a pin mounted on the plunger is received, rotation of the cam causing the pin to slide along the arcuate slot thereby to cause the displacement of the plunger. Alternatively the actuating cam may define a peripheral cam surface against which the plunger is spring biased.

Preferably the actuating cam defines cut-outs in its peripheral surface adjacent each aperture through which the actuator may be inserted into the housing, the actuator engaging in a cut-out when inserted into the housing to thereby cause rotation of the cam from an initial position, and the cut-outs being shaped such that withdrawal of the actuating member from the housing returns the cam to the initial position. Each cut-out may be divided by a partition wall extending to the periphery of the cam to prevent an actuator being engaged in a cut-out unless that actuator is provided with a slot to receive the partition wall. Preferably the actuating cam and the locking members are supported in a first part of the housing which is mounted on a second part of the housing that receives the electrical contacts, the first part of the housing being mountable in a plurality of positions on the second part to enable the selective positioning of the aperture relative to the second part of the housing.

BRIEF DESCRIPTION OF THE DRAWING

Embodiments of the present invention will now be described, by way of example, with reference to the accompanying drawings, in which.

DESCRIPTION OF THE PREFERRED EMBODIMENT

Figure 2:
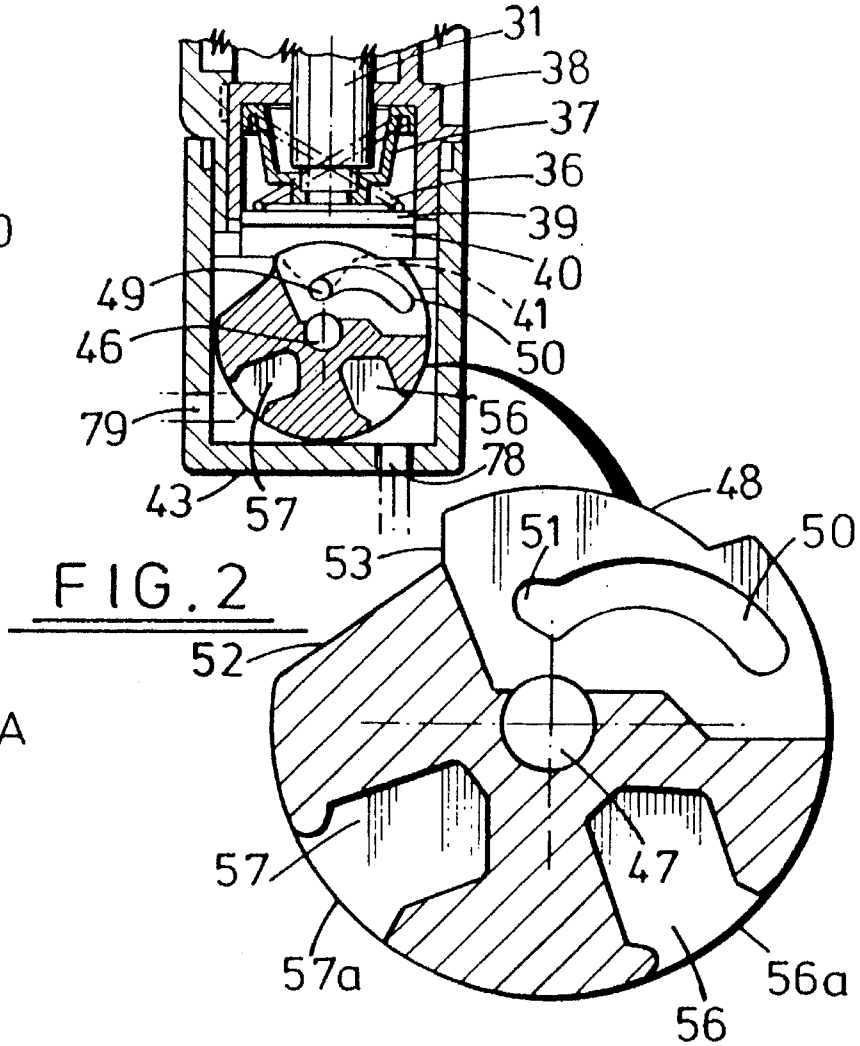
FIG. 2 is a partial sectional side view on the lines II—II of FIG. 1.
Figure 1:
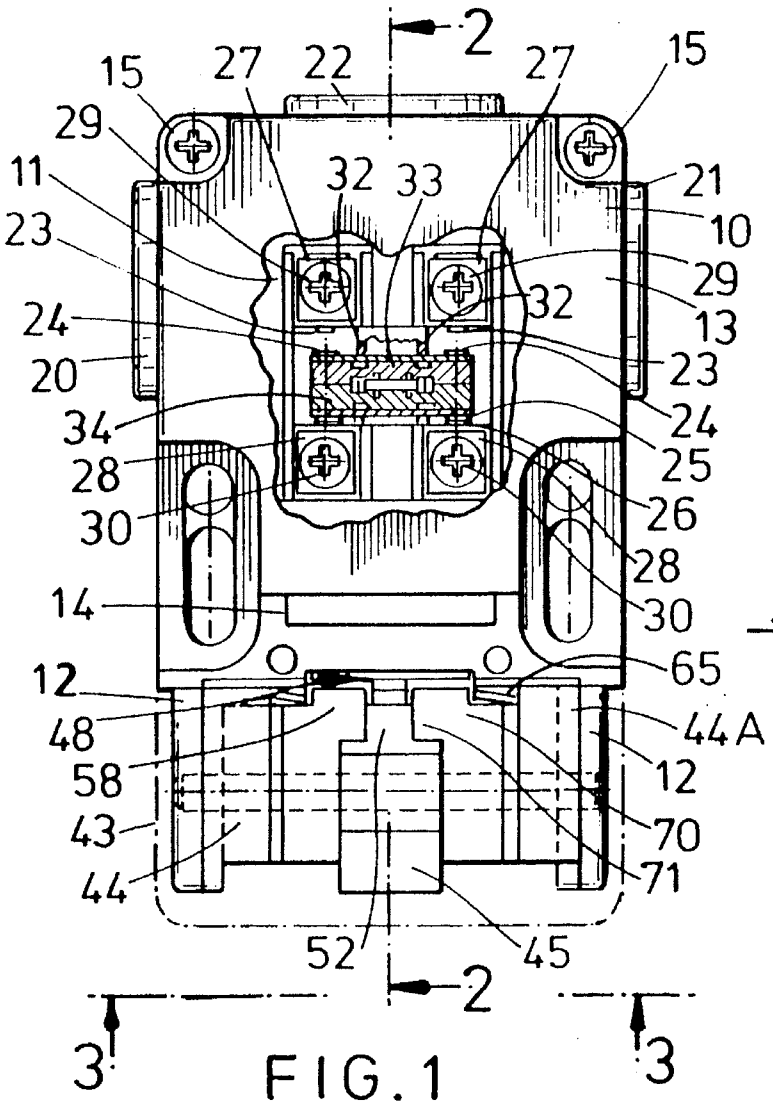
FIG. 1 is a front view of a safety switch in accordance with a first embodiment of the invention, the switch being open to show the electrical contact/actuating cam/locking members arrangement of the safety switch;.

The safety switch assemblies described below comprise a switch which contains an electrical contact arrangement, an operating cam arrangement which is mounted on the switch, a connecting arrangement which interconnects the switch and operating cam, and an actuator which operationally cooperates with the cam to actuate the safety switch.

In the embodiment of FIGS. 1 to 8, the safety switch has a glass reinforced nylon casing 10 which is self-extinguishing. The casing 10 defines an electrical contact compartment 11 at one end and, at its other end, has two parallel laterally-spaced walls 12 for mounting the cam arrangement which is described in detail below.

The contact compartment 11 is open to the front of the casing 10 and is closed by a faceplate 13 with an intervening gasket (not shown), both removable to permit access to the contact arrangement also to be described later.

The faceplate 13 is secured in position on the casing 10 by a positioning tongue 14 at one end of the faceplate 13 engageable in a slot, and screws 15 engageable at the other end of the faceplate 13 in complementary screw holes in the casing 10.

Three conduit entry ports 20 to 22 are provided for passage of a conduited electrical cable (not shown) into the contact compartment 11 for securement to the contact arrangement. Conduit entry ports 20 and 21 are disposed one at each side of the casing 10 while the conduit entry port 22 is disposed at what for convenience will be called hereinafter the top of the casing 10. Each entry port 20 to 22 is normally closed by a plug, a selected one of which is removed to provide an entry into the safety switch casing 10 for the conduited electrical cable.

The contact arrangement comprises one set of double positive break, normally-open safety contacts 23, 24 and one set of double positive break, normally-closed auxiliary contacts 25, 26. The contacts 23 and 26 are fixed in position and are provided with wire conductor clamps 27 and 28 provided with locking screws 29 and 30. The sets of contacts 23, 24 and 25, 26 are axially-spaced relative to a hollow central rod 31 and the pairs of contacts 23, 24 and 25, 26 of each set are transversely spaced to opposite sides of the rod 31. Thus, at each side of the rod 31 is a pair of contacts 23, 24 and a pair of contacts 25, 26.

The rod 31 is axially slotted at two diametrically opposed locations 32 between the fixed contacts 23 and 26. The contact pairs 24 and 25 are mounted on bridges which extend through the slots 32. The contacts 24, 24 are connected by a bridge 33 and the contacts 25, 25 are similarly connected by a bridge 34 and a spring acts on the bridges 33, 34 to ensure electrical contact between contacts 23 and 24 or contacts 25 and 26 depending upon the operational mode of the safety switch.

A compression spring 36 surrounds a spring retainer sleeve 37 and acts between a fixed horizontal wall 38 of the casing 10 and a boss or plate 39 integral with the bottom of the rod 31 to urge the latter downwards and the contacts 23, 24 and 25, 26 into their normal open and closed positions. The integral boss or plate 39 is provided with an integral T-shaped formation 40, the stem 41 of the latter pointing to the bottom of the safety switch and the cam assembly mounted thereon.

The making of contacts 23, 24 and the breaking of contacts 25, 26 and vice versa, is effected by the axial push rod 31 and associated compression spring 36, and the cam arrangement to which the push rod 31 is connected as later described.

Before describing the cam arrangement in detail reference is firstly made to the laterally-spaced apertured walls 12. Each apertured wall 12 has on its outer face locating slots which releasably receive ribs 42 mounted on an apertured end cap 43. Fixed to opposed ends of each wall 12, at right angles thereto, are fore-and-aft filler plates 44, 44A which are T-shaped in section.

The cam arrangement comprises an actuator cam 45 mounted on a shaft 46 supported at its ends in the apertures in the walls 12, which shaft extends through a central hole 47 in the actuator cam 45. The actuator cam 45 is generally of circular configuration, and is rotatable about the shaft 46. The actuator cam 45 is split around an angle of approximately ninety degrees to define a forked configuration 48, the fork defining two parallel limbs that are perpendicular to the axis of the hole 47 and are bridged by a pin 49 extending through arcuate cam slots 50 formed in the fork limbs.

The pin 49 is fixed in the stem 41, projecting from both sides thereof through the arcuate cam slots 50 and resting normally in a depression 51 at one end of each arcuate cam slot 50. The pin 49 acts as a cam follower pin.

The actuator cam 45 is cut away adjacent the forked configuration 48 to provide a flat inclined surface 52 and two stepped abutment surfaces 53, one on each side of the fork.

In the lower half of the actuator cam 45 there is formed a pair of radial cut-outs or pockets 56, 57 open to the periphery of the actuator cam 45, extending inwardly towards the shaft 46 across the thickness of the cam 45 and spaced angularly one to another. The pockets 56, 57 of the actuator cam 45 are normally positioned so as to open to the bottom of the safety switch. Each pocket 56, 57 has a radially extending dividing wall, peripheral edges 56*a*, 57*a* of the dividing wall following the cam circumference.

Figures 3, 4A, 4B, 4C, 4D:
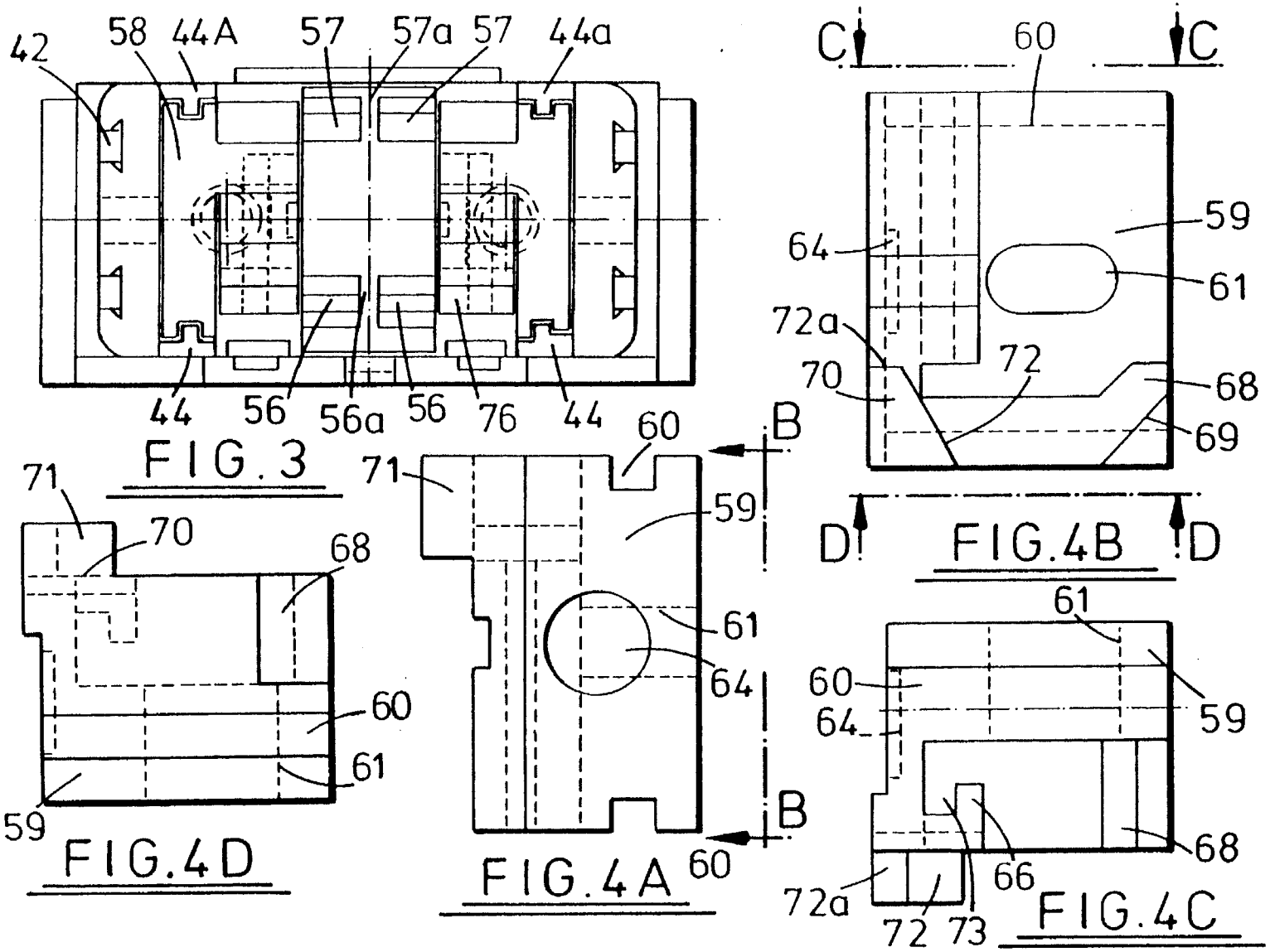
FIG. 3 is an end view on the lines III—III of FIG. 1.
FIGS. 4A to 4D show plan and side elevations of a locking block incorporated in the switch of FIG. 1.

Each side face of the actuator cam 45, adjacent wall 12 and fore-and-aft filler plates 44, 44A define a housing for a non-rotatable locking block 58. Four views of a locking block 58 appear in FIG. 4. FIG. 4B is a view on lines B—B of FIGS. 4A, FIG. 4C is a view on line C—C of FIG. 4B, and FIG. 4D is a view on lines D—D of FIG. 4B.

Each locking block 58 comprises a web 59 located adjacent and parallel to the housing wall 12. The web 59 had slots 60 in its side walls which engage the small limbs of the T-shaped filler plates 44, 44A in a sliding relationship such that the block 58 is received slidingly in the housing. Each block 58 has an elongate slot 61 through which the shaft 46 extends. A circular recess 64 is formed in the top face of the web 59 of the locking block 58 to accommodate one end of a compression coil spring 65 (FIG. 1), the other end of the latter being engaged in a recess in a wall of the housing 10 bridging the lateral walls 12. This spring 65 resiliently urges the locking block 58 away from the housing 10. The locking block 58 is dimensioned to be accommodated in the aforesaid defined housing so that its sliding movement is confined to a rectilinear path towards or away from the housing 10.

Each locking block 58 has formations which protrude towards the actuator cam 45. One side wall of each block 58 is extended and comprises a portion 68 which is ramped towards the shaft 46, the lower surface of the ramp being an actuator engaging surface 69. A portion 70 of the wall extension has a step 71 with a lower surface 72 which is ramped from the side wall to the shaft 46 and ends in an abutment surface 72*a*. Extending from the top of the web 59, above the slot 61, is a guide track 66 having an inturned formation defining a slot 73 running perpendicular to the shaft axis 46.

Figures 5A, 5B, 5C, 6, 7, 8:
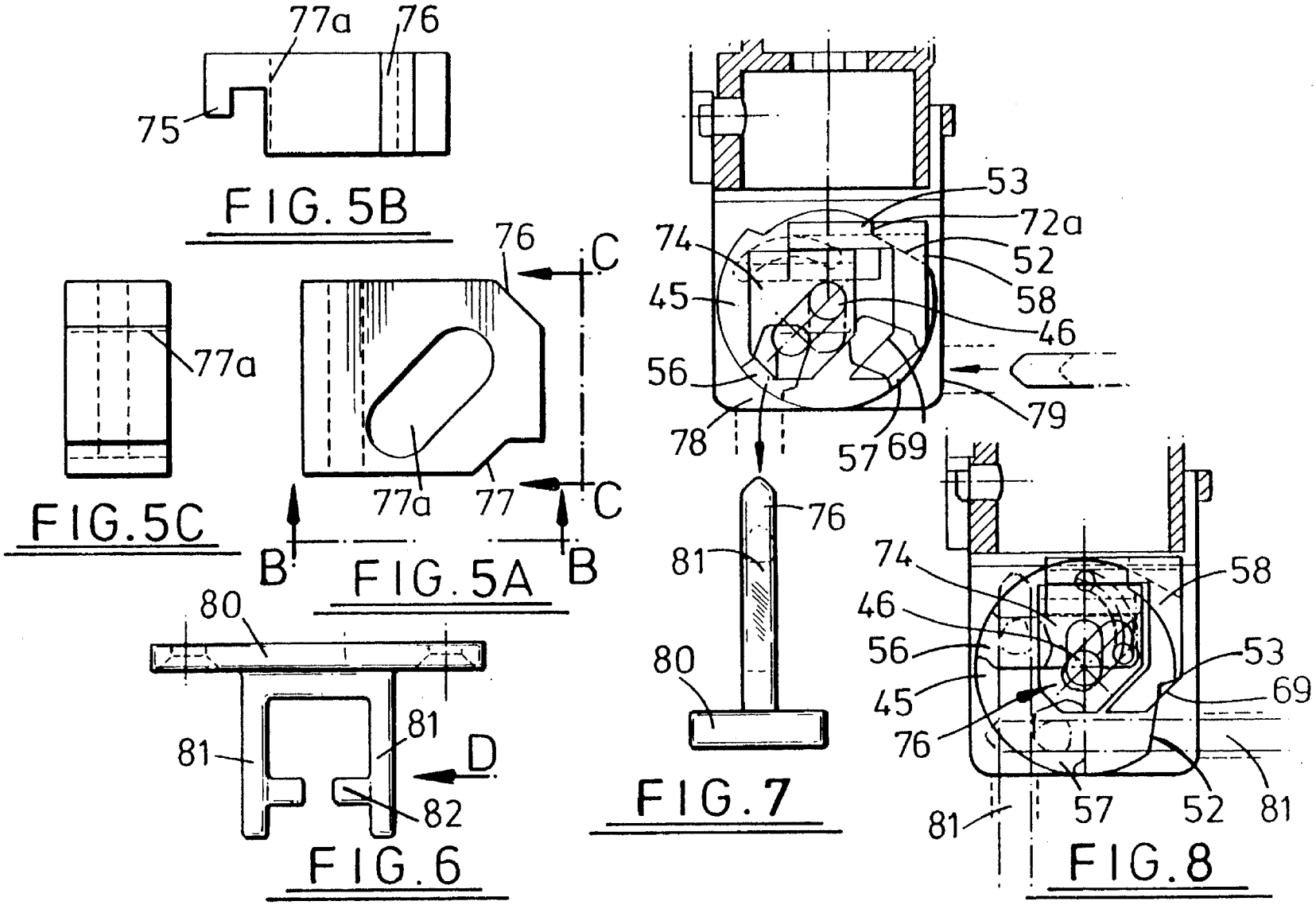
FIGS. 5A to 5C show plan and side elevations of a sliding block incorporated in the switch of FIG. 1.
FIG. 6 shows an actuator for the switch of FIG. 1.
FIGS. 7 and 8 are diagrammatic views illustrating the operation of the safety switch of FIG. 1.

Each guide track 66 and extended wall is designed to receive a sliding block 74. A sliding block is illustrated in FIG. 5, FIG. 5B and 5C being views of FIG. 5A on lines B—B and C—C respectively. Each sliding block 74 is generally rectangular and is cut-away to define a rib 75 shaped to engage in the guide track 66 (FIG. 4C) in a sliding relationship. The upper surface of the sliding block 74 has a cut-off corner which forms a ramped actuator engaging surface 76. The other corner 77 is cut away in a configuration which is designed to receive the ramped end 68 of the extended wall of the locking block 58.

Each sliding block 74 has a slot 77*a* cut through it which is the same in shape as the slot 66 in the locking block 58 but is orientated at 45 degrees to it. The slot 77*a* is angled upward from the border 76 and receives the shaft 46.

The stepped portions 71 of the extended walls of the locking blocks 58 are positioned above the flat inclined surface 52 of the actuator cam 45. The abutment surfaces 53 of the cam 45 normally abut the abutment surface 72*a* of the locking block 58.

The cam/locking block arrangement is normally enclosed by the end cap 43 which is of box-like configuration open at one end. Screw holes are adapted to be aligned with two screw holes (not shown) provided respectively at the front and the back of the housing 10 to secure the end cap 43 in position on the latter. The end cap 43 is formed with a groove or recess (not shown) for assisting liquid drainage out of the safety switch through a window (not shown) and down the groove or recess when the safety switch is being hosed down for cleaning purposes.

The end cap 43 is formed at one side of its end surface with a rectangular opening 78 defining an actuator entry slot and at one side of one side wall with a similar opening 79 (FIG. 2). The actuator entry 78 is aligned with the pocket 56 of the actuator cam 45 and the ramped corners 76 of the sliding blocks 74. Actuator entry 79 is aligned with the ramped surfaces 69 on the locking block 58 and the pocket 57 of the actuator cam 45.

The other component of the safety switch, namely the actuator, is formed for example of stainless steel. As shown in FIG. 6, it comprises a mounting bar 80, from which project two parallel actuating limbs 81 which each have an inwardly projecting ear 82 parallel to the mounting bar 80.

The above described safety switch can be used, inter alia, in connection with machinery guards, the safety switch being mounted on the guard housing and the actuator on the guard gate or door which may be hinged, slidable or of lift-off construction.

The electrical circuitry, well known to those skilled in the art of providing electrical interlocks between kinetic machinery and machine guards therefor, will not be described other than to indicate that machinery operation is inhibited until the safety contacts 23, 24 are closed and the auxiliary contacts 25, 26 are opened. The latter are signal contacts indicating the condition of the kinetic machinery and the machine guard in either condition, that is contacts 25, 26 closed indicates machinery in operation and machine guard closed, contacts 25, 26 open indicates machine guard open and machinery stopped.

Inadvertent or unauthorised rotation of the cam arrangement is prevented or resisted by the inter-engagement of the actuator cam abutment surfaces 53 and the locking block 58 abutment surfaces 72*a*.

When the guard door or gate is closed, the actuator enters the entry 78 or entry 79 depending upon the disposition of the safety switch. When the actuator enters entry 78 (see FIGS. 7 and 8) the limbs 81 of the actuator engage with the ramped surface 76 on the sliding blocks 74. The actuator forces the sliding blocks 74 to slide relative to the locking blocks 58 along the guide tracks 66. This in turn forces the locking blocks 58 to move in a rectilinear motion against springs 65, because the shaft 46 is engaged in the mutually inclined slots 61 and 77*a*. The motion is such that the abutment surfaces 72*a* of the locking block 58 move clear of the abutment surfaces 53 on the actuator cam 45. The sliding blocks 74 are displaced in a direction at 45 degrees to the direction of displacement of the locking blocks 58. The angled slot 77*a* allows the block 74 to move relative to the shaft at this angle.

After the locking blocks 58 and then sliding blocks 74 have been displaced, the actuator ears 82 engage in the peripheral pocket 56 of the actuator cam 45 and causes the cam 45 to rotate (see FIG. 7). This causes the axial push rod 31 to move axially against the action of the spring 36 to open the auxiliary contacts 25, 26 and close the safety contacts 23, 24 which condition will prevail as long as the actuator is so engaged in the safety switch.

If the actuator is positioned to enter in the entry 79, the ends of the actuating limbs 81 engage the ramp surfaces 69 of the locking blocks 58, causing rectilinear motion of the latter against the spring 65 and separation of the abutment surfaces 53, 72*a*. The actuator ears 82 then engage in the peripheral pocket 57 to rotate the actuator cam 45 as before. Thus the cam 45 rotates in the same direction if the actuator is introduced through either entry 78 or entry 79.

Retraction of the actuator out of the safety switch, in both the above cases, causes reversal of the contact conditions, that contacts 23, 24, open and contacts 25, 26 close. This is the result of the actuator cam 45 being returned to its rest position with the abutment surfaces 53 bearing against the abutment surfaces 72*a* to prevent rotation of the cam 45.

The pin 49 is connected to the contact actuator shaft and received in the arcuate slot 50 in the actuator cam. When the actuator is withdrawn, the cam returns to its original position and pulls on the pin 49. Thus the push rod 31 cannot remain unintentionally in the "machine energised" position. If the gate or door of the machinery guard is open only slightly, say, for example, 6 mm, this will cause the actuator to rotate the cam 45, displace the pin 49, and thus force disconnection of the safety contacts 23, 24. Thus, in the event of contact weld or a similar safety switch component failure, the actuator cannot be removed from the switch without forcing contact movement, thus providing complete operator safety. Additionally, the auxiliary signal contacts 25, 26 will be closed instantaneously, indicating the condition of the machinery guard.

It is to be noted that both sets of contacts 23, 24 and 25, 26 are galvanically isolated thus eliminating the possibility of voltage crossover.

An alternative contact arrangement (not shown) comprises two pairs of double positive break, normally-open contacts for use in dangerous or low voltage applications. In this arrangement it is to be noted that both the safety normally-open contacts and the auxiliary normally-open contacts are forcibly disconnected almost simultaneously.

The above described safety switch and actuator is installed by mounting the safety switch at any convenient position of the machinery guard and the actuator on an opening edge of the guard door or gate aligned with the entry 78 or alternatively the entry 79.

Referring now to FIGS. 9 to 17 of the drawings, the illustrated second embodiment of the invention comprises a safety switch which contains an electrical contact arrangement, an operating cam arrangement, a connecting rod arrangement, and an actuator which operationally cooperates with the safety switch. In this second embodiment parts common to the first embodiment described above are given the same reference numerals but incremented by 100.

Figure 9:
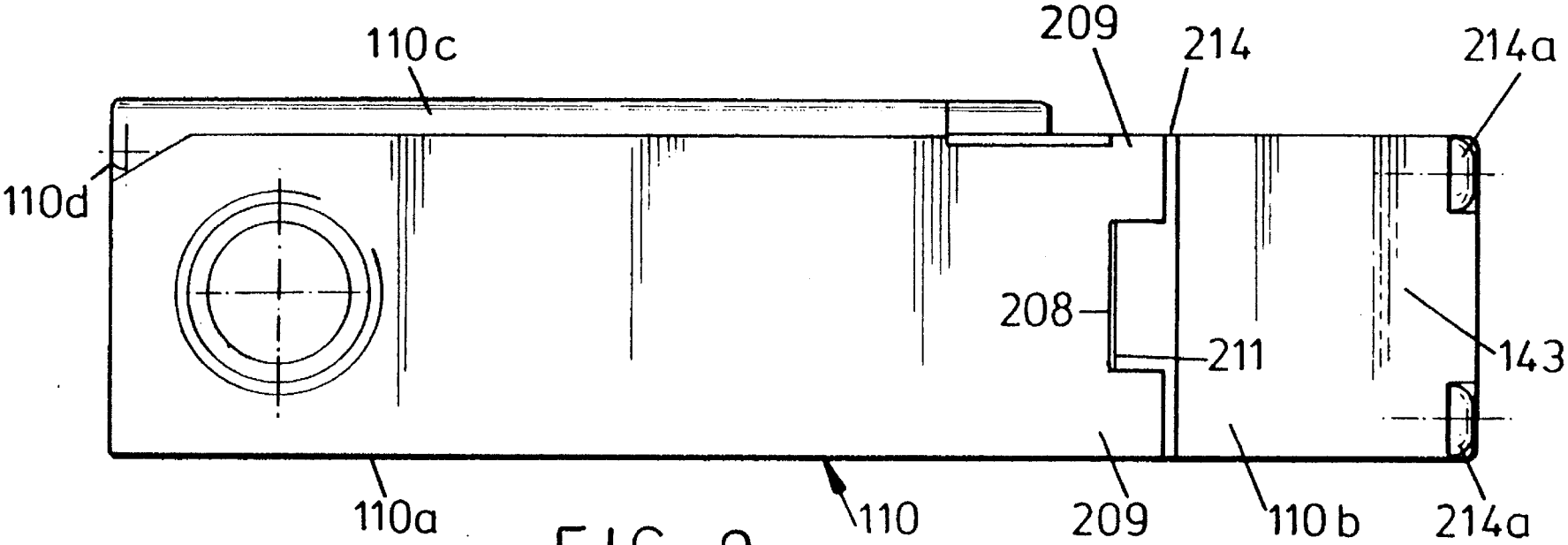
FIG. 9 is a view of a safety switch in accordance with a second embodiment of the present invention.
Figure 10:
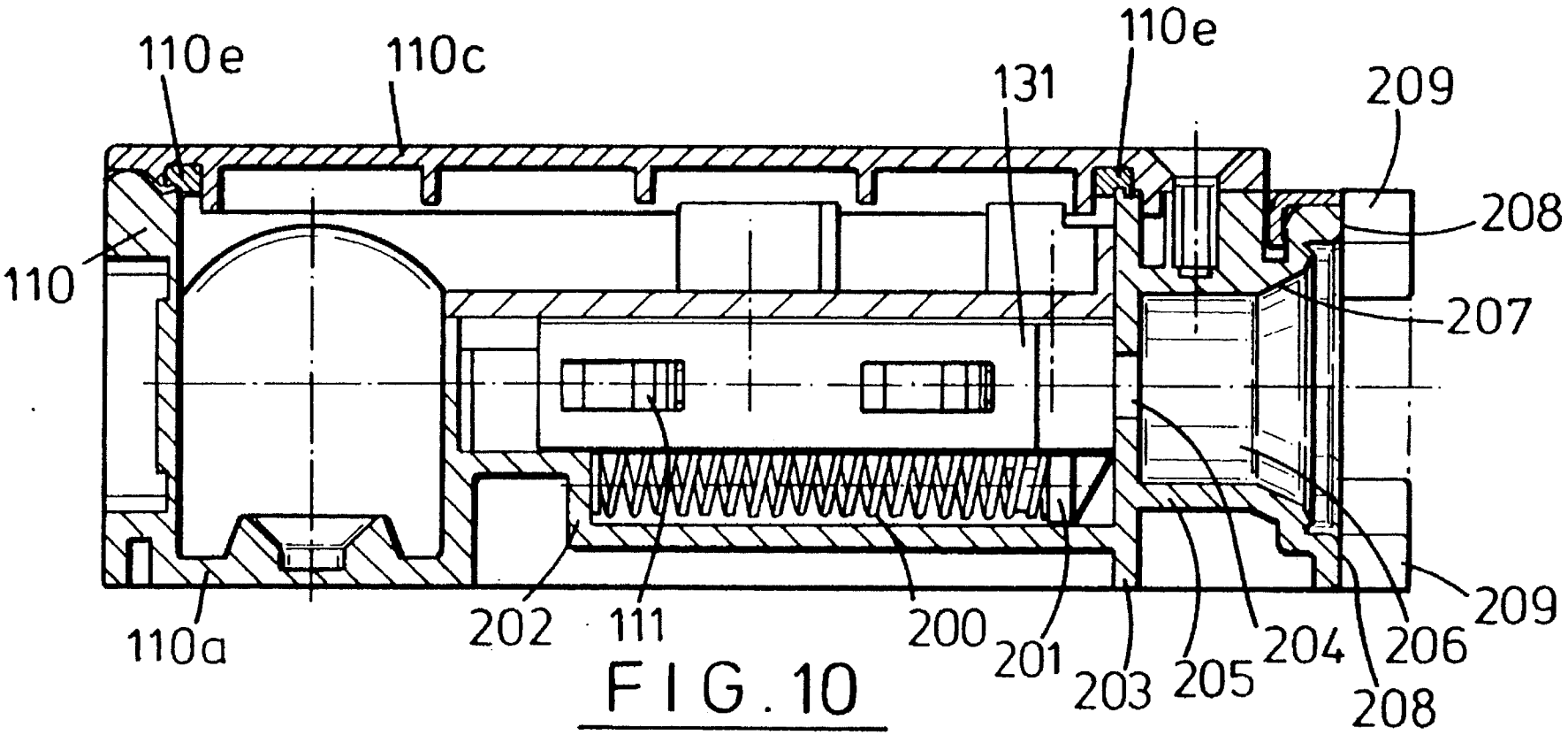
FIG. 10 is a sectioned view of an upper section of the safety switch of FIG. 9.

As can be seen from FIGS. 9 and 10, the safety switch comprises a glass reinforced nylon casing 110 which is square in cross section and comprises two sections. An upper section 110*a* of the casing houses an electrical contact compartment 111 and a lower section 110*b* of the casing houses the cam arrangement. The two sections of the casing are separable. The upper section 110*a* has a cover 110*c* hinged at end 110*d* which when open exposes the contact compartment 111. A seal 110*e* is located between the cover 110*c* and the case 110.

The lower section 110*b* is normally enclosed by an end cap 143 of box-like configuration open at one end. Screw holes are adapted to be aligned with two screw holes (not shown) provided respectively at the front and the back of the upper section 110*a* of the housing 110 to secure the end cap 143 in position on the latter.

The contact compartment 111 is substantially similar to that described with reference to FIGS. 1 to 8. It comprises fixed contacts 123, 126 and moveable contacts 124, 125.

Figure 14:
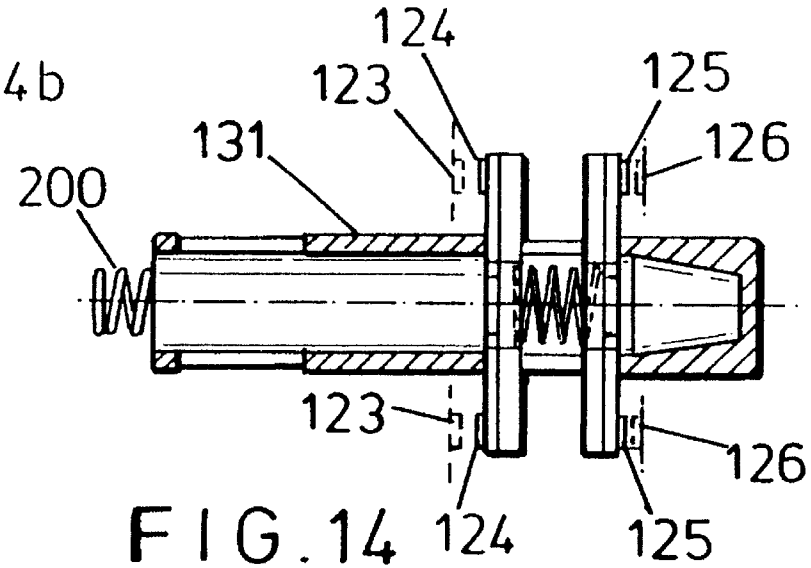
FIG. 14 is a part sectioned view of a push rod of the safety switch of FIG. 9.

In FIG. 14, the sets of moveable contacts 124, 125 are shown axially-spaced relative to a hollow central rod 131. The fixed contacts 123, 126 mounted in the housing 110 are shown dotted. At each side of the rod 131 is a pair of contacts 123, 124 and a pair of contacts 125, 126. When contacts 125, 126 are closed and contacts 123, 124 are open the power supply to OFF. When the state is reversed the power supply is ON.

A compression spring 200 acts between a lateral extension 201 of the rod 131 and a fixed horizontal ledge 202 of the casing 110 to urge the rod 131 downwards and the contacts into their normal open and closed positions, such that the power supply is OFF (see FIG. 10).

The lower end of the upper section 110*a* of the casing 110 has a dividing wall 203 with a central aperture 204. On the side of the wall 203 opposite the contacts there is a depending annular wall 205 forming a socket 206. The socket 206 is outwardly tapered as indicated by numeral 207 towards an upper mating surface 208. The upper mating surface 208 is parallel to the dividing wall 203 and has at each of its four corners equispaced locating lugs 209 which have threaded apertures (not shown).

Figure 12:
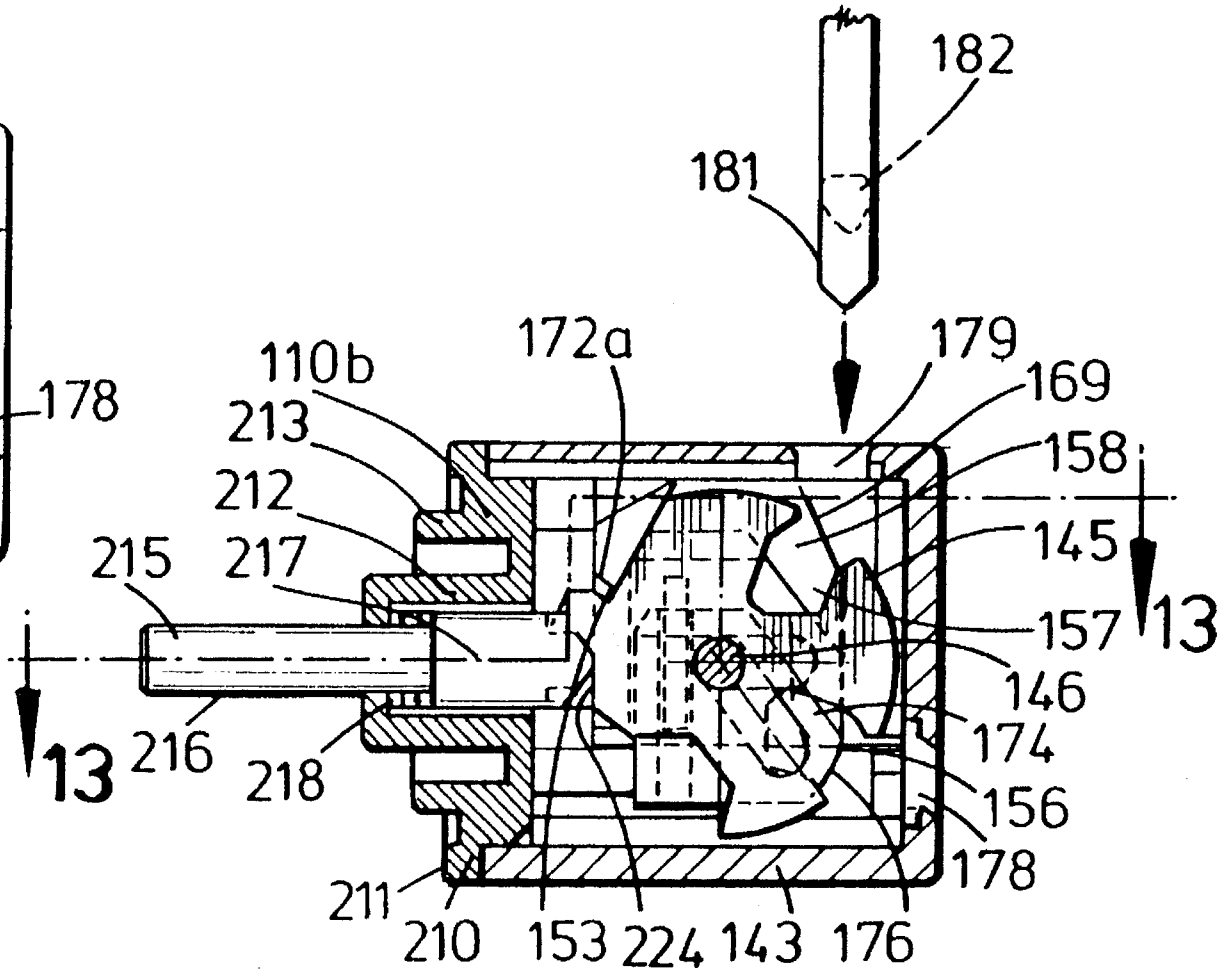
FIG. 12 is a sectioned view along line 12—12 of FIG. 11.
Figure 11:
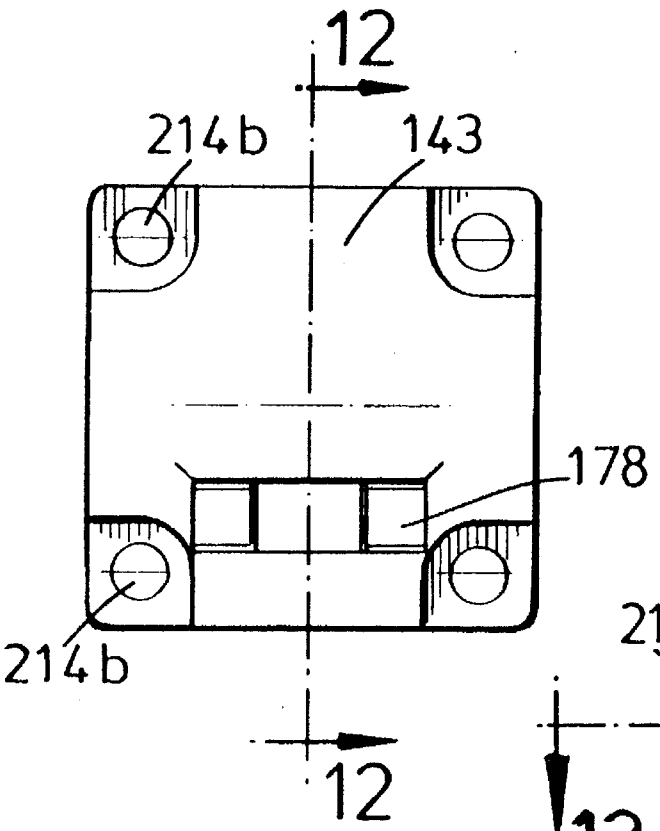
FIG. 11 is an end view of the safety switch of FIG. 9.
Figure 13:
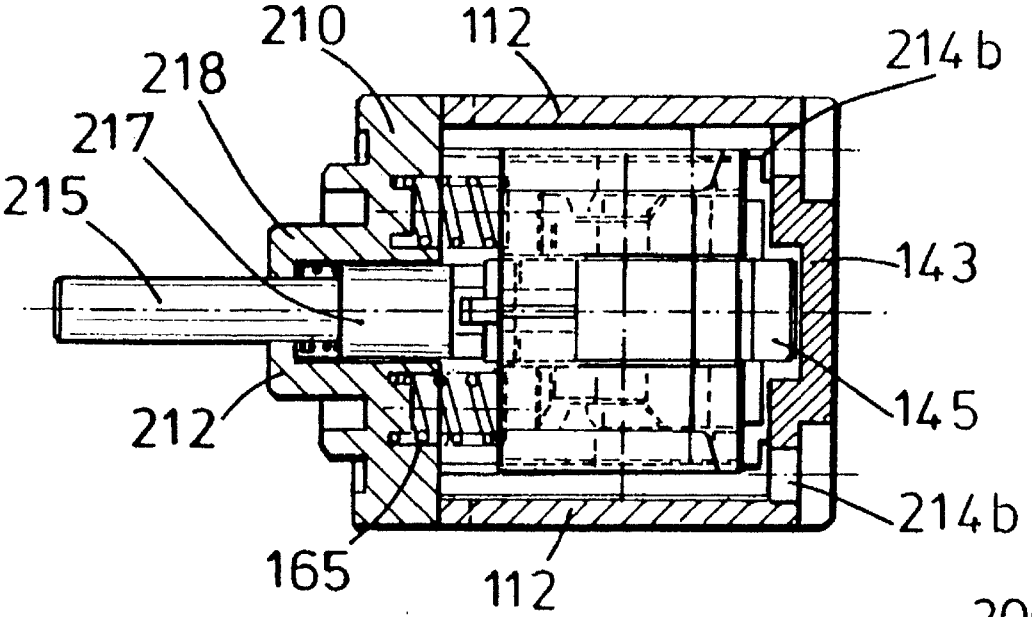
FIG. 13 is a sectioned view along line 13—13 of FIG. 12.

The lower section 110*b* of the casing, shown in FIGS. 12 and 13, comprises a wall 210 having on one side a lower mating surface 211 and on the other side two laterally spaced walls 112 for mounting the cam arrangement.

The lower mating surface 211 has a central apertured spigot 212 which is designed to locate in the socket 206 of the upper casing 110*a* and an annular wall 213 which locates in the taper 207 of the socket 206. Each corner of the lower mating surface 211 has cut-outs 214 which are designed to receive the locating lugs 209 of the upper mating surface 208 (see FIG. 9). In the cut-out areas 214 the wall 210 has apertures (not shown) which correspond to those in the locating lugs 209. The upper section 110*a* and lower section 110*b* are connected together by screws 214*a* which pass through apertures 214*b* (see FIGS. 9, 11 and 13) in the cap 210 and the apertures in the cut out areas 214 and locate in the threaded apertures of lugs 209. As the mating surfaces 208,211 are symmetrical the lower section 110*b* of the case may be located in any one of four positions. Each new position is achieved by rotating the lower section 110*b* relative to the upper 110*a* by 90 degrees about the longitudinal axis of the safety switch assembly.

A spring-loaded plunger 215 extending along the longitudinal axis has a shaft 216 and a head 217 and is seated in the aperture of the spigot 212. The shaft 216 extends through the aperture 204 into the upper section 110*a* of the case 110 to abut the rod 131 and moves the rod 131 against the bias of the compression spring 200 such that the contacts 123, 124, 125, 126 are held in a power supply off position. The end of the head 217 of the plunger 215 is pointed and abuts the cam arrangement. The plunger 215 is biased by a compression spring 218 into contact with the cam arrangement.

The cam arrangement comprises an actuator cam 145 mounted on a shaft 146 supported at its ends in the apertures in the walls 112, which shaft extends through a central hole 147 in the actuator cam 145.

Figures 15, 16A, 16B, 16C:
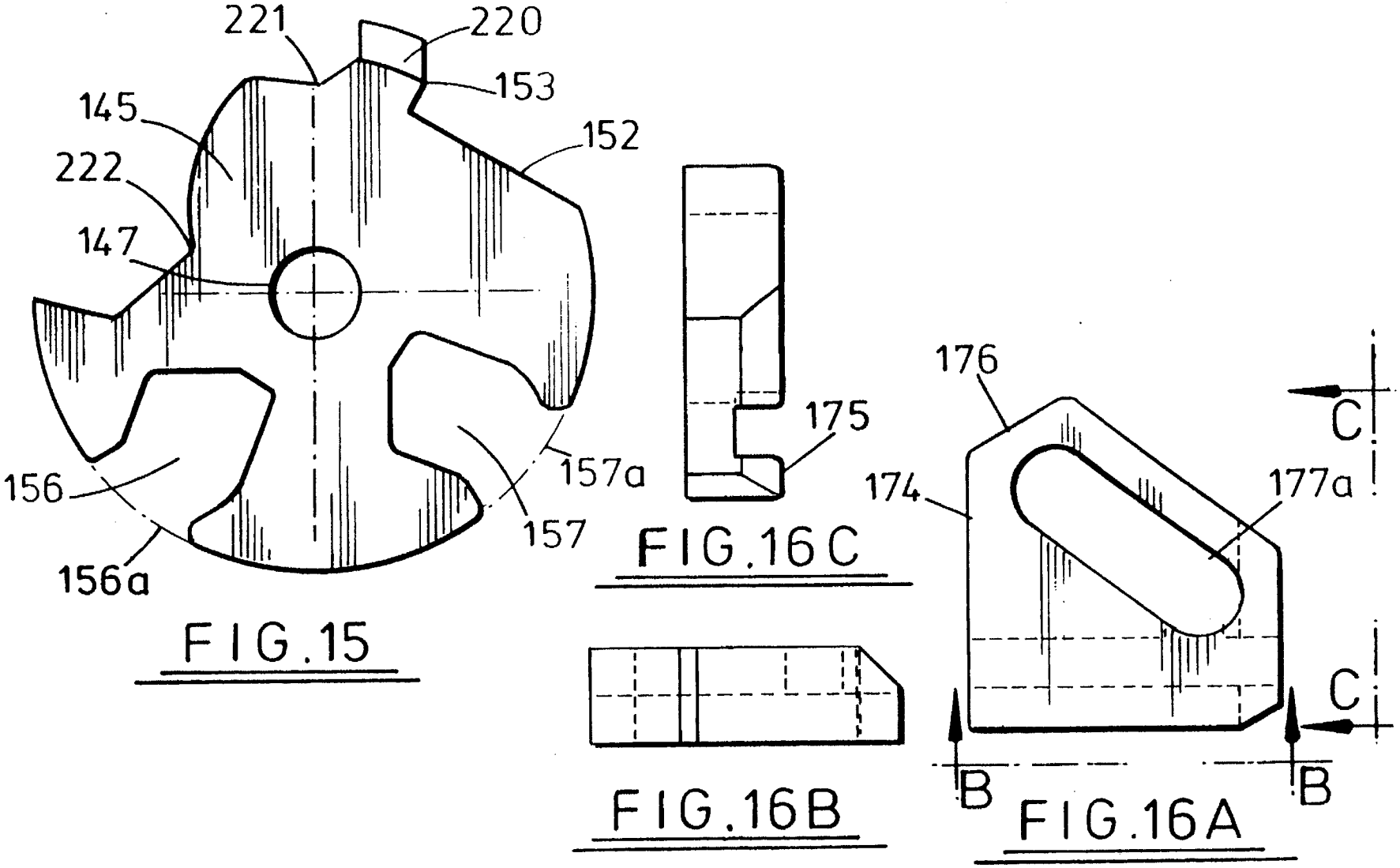
FIG. 15 is a side view of an actuator cam of the safety switch of FIG. 9.
FIGS. 16A, 16B and 16C show three views of a sliding block of the safety switch of FIG. 9.
Figure 17C:
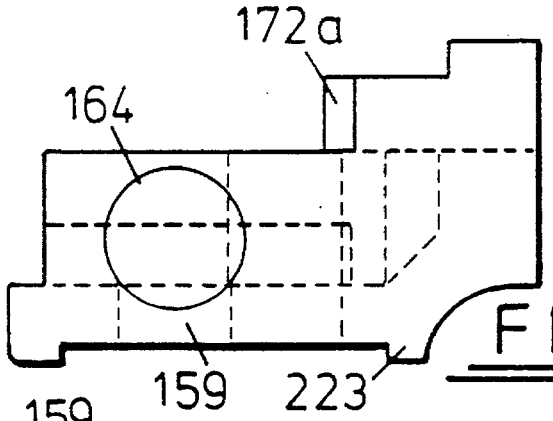
FIGS. 17A, 17B, 17C and 17D show four views of a locking block of the safety switch of FIG. 9.
Figure 17A:
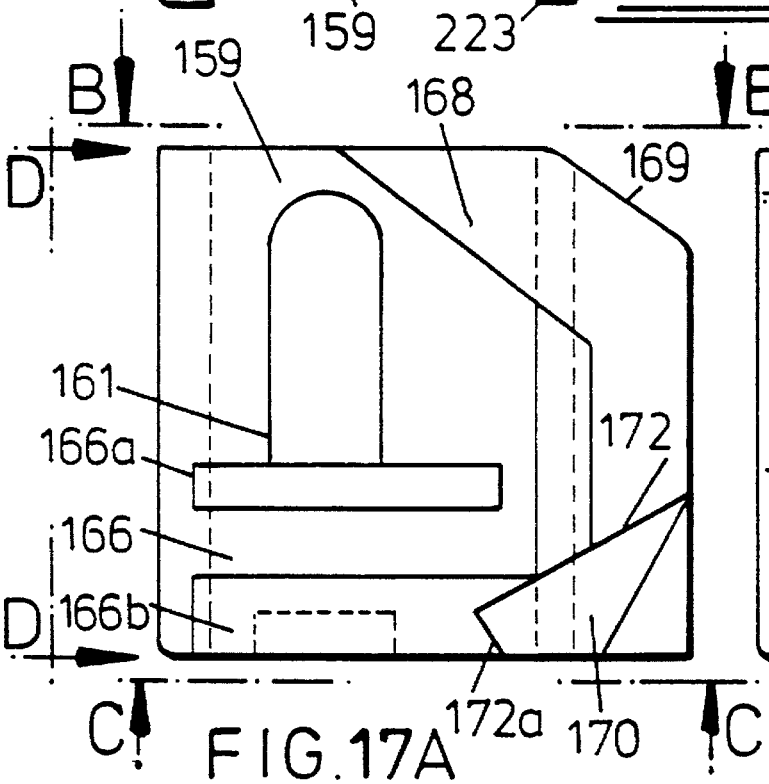
Figure 17D:
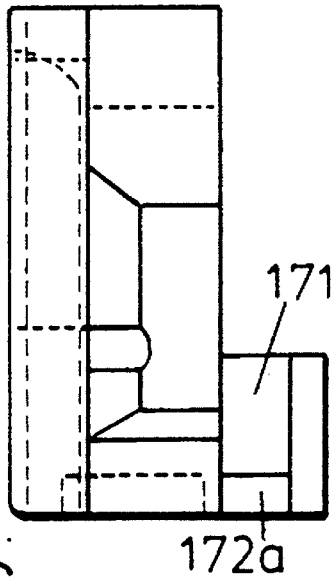
Figure 17B:
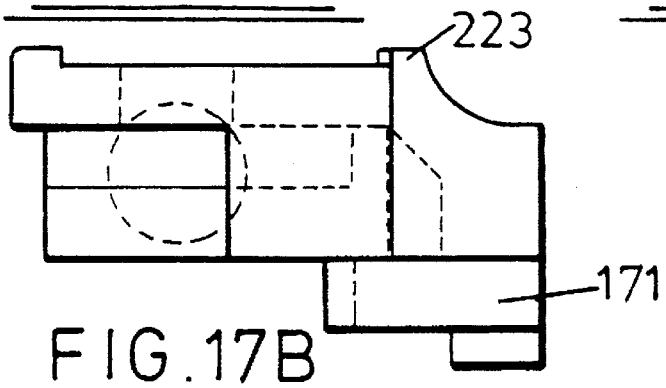

The actuator cam 145 shown in detail in FIG. 15, is generally of circular configuration, and is rotatable about the shaft 146.

An upper portion of the actuator cam 145 (as shown in FIG. 15) is laterally cut away to provide a flat inclined surface 152, a tooth 220 with a stepped abutment surface 153 and a depression 221. The depression 221 is shaped to received the pointed head 217 of the plunger 215.

In the lower half of the actuator cam 145 there is formed a pair of angularly spaced radial cut-outs or pockets 156,157 open to the periphery of the actuator cam 145, extending inwardly towards the shaft 146 and across the thickness of the cam 145. Planar webs extending perpendicular to the axis of central hole 147 extend radially to peripheral edges 156*b*, 157*a*. These webs, which divide the pockets 156, 157 in half, are not shown in FIGS. 12 to make it easier to appreciate the detailed design of components associated with the actuator cam.

The cam arrangement includes locking blocks 158 and sliding blocks 174. One locking block 158 is shown in detail in FIG. 17, FIGS. 17B, 17C and 17D being views on lines B—B, C—C and D—D of FIG. 17A respectively. Each block 158 comprises a web 159 adjacent and parallel to the housing wall 112. The web 159 has a ridge 223 which engages in a corresponding groove (not shown) in each of the parallel walls 112 of the lower section 110*b* of the case. Each block 158 has an elongate slot 161 through which the shaft 146 extends.

A circular recess 164 is formed in the top face of the web 159 of the locking block 158 to accommodate one end of a compression coil spring 165 (see FIG. 13), the other end of the latter being engaged in a recess in the wall 210 of the lower section 110*b* of housing 110 bridging the lateral walls 112. This spring 165 resiliently urges the locking blocks 158 away from the wall 210.

Each locking block 158 is dimensioned to be accommodated in the housing so that its sliding movement is confined to a rectilinear path towards or away from the wall 210 of the lower section 110*b*.

Each locking block 158 has formations which protrude towards the actuator cam 145. A lower portion 168 is ramped downwards towards the shaft 146, the lower surface of the ramp being an actuator engaging surface 169. An upper portion 170 of the block 158 has a step 171 with a lower surface 172 which is ramped upwardly from the side wall to the shaft 145 and ends in an abutment surface 172*a*. At the top of the web 159, above the slot 163, is a guide track 166 formed between two ridges 166*a* and 166*b* running perpendicular to the shaft axis 46.

Each guide track 166 is designed to receive a respective sliding block 174, one of which is shown in FIGS. 16, FIGS. 16B and 16C being views on lines B—B and C—C respectively of FIGS. 16A. Each sliding block 174 is rectangular and has a cut-out recess forming an end ridge 175 which is received in the guide track 166 of the adjacent locking block 158 in a sliding relationship. The upper surface of the sliding block 174 has a cut-off corner which forms a ramped actuator engaging surface 176.

Each sliding block 174 has a slot 177*a* cut through it which is orientated at 45 degrees to the slot 161 in the locking block 158. The slot 177*a* is angled upward from the corner 176 and receives the shaft 146.

The end cap 143 is formed at one corner of its top surface with a rectangular opening 178 defining an actuator entry slot and at one corner of its front face with a similar opening 179.

The actuator entry 178 is aligned with the pocket 156 of the actuator cam 145 and the ramped corner 176 of the sliding block 174. Actuator entry 179 is aligned with the ramped surface 169 on the locking block 158 and the pocket 157 of the actuator cam 145.

The other component of the safety switch, namely the actuator, may be of the form illustrated in FIG. 6. The tip of such an actuator is shown in FIG. 12, comprising side limbs 181 supporting actuator ears 182.

Inadvertent or unauthorised rotation of the cam arrangement is prevented by the inter-engagement of the actuator cam abutment surfaces 153 and the locking block 158 abutment surface 172*a*. When the guard door or gate is closed, the actuator enters the entry 178 or entry 179 depending upon the disposition of the safety switch.

When the actuator enters entry 178 the limbs 181 of the actuator engage with the ramped surface 176 on the sliding blocks 174. The actuator forces the sliding blocks 174 to slide relative to the locking blocks 158 along the guide track 166, and this forces locking blocks 158 to move in a rectilinear motion against springs 165. The motion is such that the abutment surfaces 172*a* of the locking blocks 158 move clear of the abutment surface 153 on the actuator cam 145. The angled slots 177*a* allow the blocks 174 to move relative to the shaft 146 at an angle of 45 degrees to the axis of plunger 215.

After the sliding blocks 174 have begun to move, the actuator ears 182 engage in the peripheral pocket 156 of the actuator cam 145 and cause the cam 145 to rotate and consequently the head 217 of the plunger 215 to be released from the depression 221 in the cam 145. The plunger 215 acts as a cam follower to move rectilinearly under the influence of the compression spring 218 and is received in the recess 222 of the cam 145. The movement of the plunger 215 permits the rod 131 in the upper casing 110*a* to move under the bias of the spring 200 such that the contacts are held in the power supply ON position. This condition will prevail as long as the actuator is so engaged in the safety switch.

If the actuator is positioned to enter in the entry 179 the ends of the actuating limbs 181 engage the ramp surfaces 169 of the locking blocks 158, causing rectilinear motion of the latter against the spring 165 and separation of the abutment surfaces 153, 172*a* as before. The ears 182 then engage in the other peripheral pocket 157 to rotate the actuator cam 145 as before.

Retraction of the actuator out of the safety switch causes reversal of the contact conditions. As the actuator is withdrawn the actuator cam 145 is forced to return to its rest position with the abutment surfaces 153 bearing against the abutment surfaces 172*a* to prevent rotation of the cam 145. The plunger 215 returns to rest in the depression 221 of the cam 145.

The direction of rotation of the actuator cam 145 when the actuator is inserted is the same irrespective of which entry slot is entered by the actuator.

The fact that the separable upper and lower sections can be secured together in different relative orientations, allows the actuator entry ports in the cover of the lower casing to be orientated as is required by the application concerned.

It will be appreciated that the actuating cam/locking block and push rod arrangement of the second embodiment can be used to operate electrical switches other than those described with reference to the drawings.

I claim:

1. A safety switch, comprising:

a housing containing electrical contacts movable between a power supply off position and a power supply on position by rotation of an actuating cam also contained within the housing and rotatable about a predetermined axis by an actuator of a predetermined shape insertable into the housing, at least one locking member mounted for movement in a direction substantially perpendicular to the axis of rotation of the actuating cam, the at least one locking member being resiliently urged towards a position in which the at least one locking member locks the actuating cam against rotation and consequent movement of the electrical contacts to the power supply on position, the housing defining first and second apertures through which the actuator is insertable, the actuator when inserted into each of the apertures engages the at least one locking member and displaces the at least one locking member away from a path of movement of the actuator into a position in which the actuating cam is free to rotate relative to the housing, and engages and rotates the cam to cause movement of the electrical contacts to the power supply on position, the at least one locking member comprising first and second slidably interengaged components, the first and second components defining interengaging surfaces configured such that displacement of the first component in a first direction causes the second component to be displaced in a second direction and displacement of the second component in the second direction causes the first component to be displaced in the first direction, the actuator being configured such that when inserted through the first aperture the actuator pushes the first component in the first direction and when inserted through the second aperture the actuator pushes the second component in the second direction.

2. The safety switch of claim 1, wherein the at least one locking member is slidably mounted on tracks defined by the housing.

3. The safety switch of claim 1, wherein the actuating cam is caused to rotate in a common direction by insertion of the actuator through the first aperture and insertion of the actuator through the second aperture.

4. The safety switch of claim 1, wherein each of the first and second locking member components defines an elongate slot through which a shaft mounted on the housing extends, the slots being mutually inclined and each slot defining a relative direction in which the locking member component is forced to move.

5. The safety switch of claim 4, wherein the first locking member component is slidable relative to the housing in a first direction, the second locking member component is slidable relative to the first locking member component in a second direction, the first and second directions being substantially mutually perpendicular, and wherein the slots are mutually inclined at an angle of approximately 45°.

6. The safety switch of claim 1, wherein the first locking member component is biased by a compression spring bearing against a wall of the housing towards a position in which the first locking member component engages and locks the actuating cam against rotation.

7. The safety switch of claim 1, wherein the actuating cam defines at least one abutment surface which is engageable by the at least one locking member and acts on a plunger which is movable to control the electrical contacts.

8. The safety switch of claim 7, wherein the actuating cam defines an arcuate slot in which a pin mounted on the plunger is received, rotation of the cam causing the pin to slide along the arcuate slot thereby to cause a displacement of the plunger.

9. The safety switch of claim 7, wherein the actuating cam defines a peripheral cam surface against which the plunger is spring biased.

10. The safety switch of claim 7, wherein the actuating cam defines at least one cut-out in a peripheral surface on the cam adjacent each aperture through which the actuator may be inserted into the housing, the actuator engaging the at least one cut-out when inserted into the housing to thereby cause rotation of the cam from an initial position, and the at least one cut-out being shaped such that withdrawal of the actuating member from the housing returns the cam to an initial position.

11. The safety switch of claim 7, wherein the at least one cut-out is divided by a partition wall extending to the peripheral surface of the cam, whereby the actuator is prevented from being engaged in the at least one cut-out unless the actuator is provided with a slot to receive the partition wall.

12. The safety switch of claim 1, wherein the actuating cam and the at least one locking member are supported in a first part of the housing which is mounted on a second part of the housing that receives the electrical contacts, the first part of the housing being mountable in a plurality of positions on the second part to enable selective positioning of the aperture relative to the second part of the housing.

13. A safety switch, comprising:

a housing containing electrical contacts movable between a power supply off position and a power supply on position by rotation of an actuating cam also contained within the housing and adapted to be rotated about a predetermined axis by an actuator of a predetermined shape insertable into the housing, at least one locking member mounted within the housing for movement in a direction perpendicular to the axis of rotation of the actuating cam, the at least one locking member being resiliently urged towards engagement with the actuating cam to prevent rotation thereof and consequent movement of the electrical contacts to the power supply on position, the actuator being shaped such that when inserted into the housing the actuator engages and displaces the at least one locking member away from the path of movement of the actuator and out of engagement with the actuating cam and engages and rotates the cam to cause movement of the electrical contacts to the power supply ON position, the housing defining two apertures through which the actuator is insertable to contact the at least one locking member and the actuating cam, the two apertures opening in mutually perpendicular directions, the at least one locking member comprising a first component slidably mounted on the housing and a second component slidably mounted on the first component, the first and second components being arranged such that insertion of the actuator through one aperture causes the actuator to contact one component whereas insertion of the actuator through the other aperture causes the actuator to contact the other component.

14. The safety switch of claim 13, wherein the first component and the second component each define an elongate slot through which a shaft mounted on the housing extends, the slot defined in the first component and the slot defined in the second component being mutually inclined, the slot in the first component defining a direction in which the first component is forced to move relative to the housing, the slot in the second component defining a direction in which the second component is forced to move relative to the housing.

15. A safety switch according to claim 14, wherein the second locking member component is slidable relative to the first component in a direction perpendicular to the direction in which the first component is slidable relative to the housing, and the slots are inclined at an angle of 45° to each other.

16. A safety switch according to claim 13, wherein the first locking member component is spring biased by a compression spring bearing against a wall of the housing towards a position in which the first component engages and locks the actuating cam against rotation.

* * * * *